US006076911A

United States Patent [19]

Watanabe

[11] Patent Number: 6,076,911

[45] **Date of Patent: *Jun. 20, 2000**

[54] RECORDING APPARATUS AND RECORDING CONTROL METHOD

[75] Inventor: Takashi Watanabe, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/384,921

[22] Filed: Feb. 7, 1995

[30] Foreign Application Priority Data

Feb. 8, 1994 [JP] Japan ..... 6-014536

[51] Int. Cl.[7] ..... B41J 29/38; B41J 23/00

[52] U.S. Cl. ..... 347/16; 347/37

[58] Field of Search ..... 347/16, 37; 400/317.1, 400/323

[56] References Cited

U.S. PATENT DOCUMENTS

| | | | |
|---|---|---|---|
| 4,037,230 | 7/1977 | Fujimoto et al. | 346/75 |
| 4,660,077 | 4/1987 | Kawamura et al. | 358/75 |
| 4,725,849 | 2/1988 | Koike et al. . | |
| 4,761,085 | 8/1988 | Angst et al. | 400/323 |
| 5,250,957 | 10/1993 | Onazato | 346/1.1 |
| 5,258,773 | 11/1993 | Arakawa et al. | 346/1.1 |
| 5,334,920 | 8/1994 | Ito et al. | 318/685 |
| 5,368,402 | 11/1994 | Takahashi et al. | 400/279 |
| 5,430,469 | 7/1995 | Shioya et al. | 347/15 |
| 5,433,543 | 7/1995 | Sturman | 400/314 |

FOREIGN PATENT DOCUMENTS

| | | |
|---|---|---|
| 0267125 | 5/1988 | European Pat. Off. . |
| 0373558 | 6/1990 | European Pat. Off. . |
| 0459515 | 12/1991 | European Pat. Off. . |
| 62-053492 | 3/1987 | Japan . |
| 1-308673 | 12/1989 | Japan . |
| 3046589 | 7/1991 | Japan . |
| 5-124293 | 5/1993 | Japan . |
| 5212851 | 8/1993 | Japan . |

*Primary Examiner*—Safet Metjahic
*Assistant Examiner*—Christopher Mahoney
*Attorney, Agent, or Firm*—Fitzpatrick, Cella, Harper & Scinto

[57] ABSTRACT

A carriage effects image recording on a recording medium during reciprocating motions in the main scanning direction on the recording medium. At a timing in the forward movement and in the reverse movement, an instruction is given to start the conveying operation of the recording medium, and, in response a conveying apparatus moves the recording medium by a predetermined amount in the sub-scanning direction, corresponding to the recording scanning width of the recording head. This movement of the recording medium is completed during the deceleration, stopping, reversing and acceleration of the carriage, before the arrival thereof at the recording start position. The recording process speed can be increased since the conveying operation of the recording medium is completed while the recording head executes operations required for the reversing of the moving direction. Also disclosed is the control in case the conveying operation of the recording medium is not completed.

31 Claims, 13 Drawing Sheets

RECORDING APPARATUS AND RECORDING CONTROL METHOD

BACKGROUND OF THE INVENTION

1. Field of the Invention

The present invention relates to a recording apparatus for forming a visible image on a recording medium by receiving supply of image data, and a recording control method therefor.

2. Related Background Art

In a recording apparatus employing an ink jet recording head, formation of a visible image on a recording medium has been achieved by recording scanning operation, by reciprocating motion of the ink jet recording head on the recording medium. In particular, there has recently been developed an ink jet recording apparatus designed for recording on a large-sized recording medium such as wall paper. In such recording apparatus, a printing unit including an ink jet recording head is separated from a conveying unit for conveying the recording medium, and the printing operation is conducted by the combination of a reciprocating scanning operation of the recording head in the main scanning direction and transportation of the recording medium in the subscanning direction, through communication between the units.

The U.S. patent application Ser. No. 08/258,455 of the present applicant, filed on Jun. 10, 1994, discloses, in such recording apparatus in which the conveying unit for conveying the recording medium and the printing unit including the recording head are separated, to effect the recording operation by communication between the conveying unit and the printing unit through a predetermined communication protocol, and to achieve printing on a printing medium with a joint in such a manner that the recording head does not touch the joint portion.

In general, the recording head is mounted on a unit, called carriage, for supporting the recording head, and such carriage is connected to a driving device and moves the recording head in the scanning direction to achieve the recording operation. The driving device is so designed to drive the carriage with a speed matching the characteristics of the recording head. However, the driving device requires a certain time, depending on the characteristics thereof, to reach a predetermined speed from the stopped state or to reach the stopped state from the predetermined speed.

In the communication between the printing unit and the conveying unit in the above-explained conventional recording apparatus, a conveying request signal for the printing medium is sent from the printing unit to the conveying unit while the recording head is in the stopped position. The stopped position is so selected that the recording head is sufficiently distant, in the scanning direction, from the printing medium and does not hinder the conveying operation thereof. Also in the stopped position, the printing unit receives, from the conveying unit, a signal indicating the completion of conveying operation of the printing medium, and starts the scanning operation for next recording.

Although the time and the moving distance of the recording head, other than those required for the actual recording operation of the recording head, are unavoidable because of the characteristics of the driving device, it will be apparent that there can be realized a higher printing speed and a more dimension of the apparatus as such time and moving distance become smaller.

SUMMARY OF THE INVENTION

In consideration of the foregoing, the object of the present invention is to provide a recording apparatus and a recording control method, enabling conveyance of the recording medium while the recording head is not in the stopped position, thereby shortening the process time for recording.

The above-mentioned object can be attained, according to the present invention, by a recording apparatus comprising recording means for causing reciprocating motions of a recording head in the main scanning direction in succession on a recording medium and causing the recording head to effect a recording operation on the recording medium during the moving period of the reciprocating motion; output means for releasing a signal for instructing the conveyance of the recording medium, at the end of the recording by the recording head in the moving period; and conveying means for conveying the recording medium by a predetermined amount in the subscanning direction, in response to the signal released by the output means.

In the above-mentioned configuration, the recording is executed during the forward or reverse moving period in the reciprocating motion of the recording head, repeated in succession by the recording means. Then, the conveying operation of the recording medium is instructed at the end of the recording during the moving period, and the conveying means executes the conveying operation of a predetermined amount according to the instruction. Thus, after the end of the recording, the conveying operation of the recording medium can be completed within a period required by the recording head for deceleration, stopping and start of motion in the opposite direction, until the start of recording of a next line, so that the recording process time can be shortened.

Stated differently, the recording process speed can be improved by conducting the operation for inverting the moving direction of the recording head and the conveying operation of the recording medium in parallel manner.

Preferably, there are further provided confirmation means for confirming the completion of conveying operation by the conveying means at the start of recording by the recording head during the moving period thereof, and inhibition means for inhibiting the execution of recording in the moving period in case the completion of conveying operation is not confirmed by said confirmation means.

Such configuration avoids the failure in recording, since the recording in the recording scanning motion is inhibited in case the conveying operation of the recording medium by the predetermined amount is not completed until the start of recording, for example by a trouble in the conveying system.

Further, preferably there is provided waiting means for causing the recording head to wait in a predetermined waiting position, until the conveying operation by the conveying means is completed after the end of the moving period in which the execution of recording is inhibited by the inhibition means.

In such configuration, the recording head waits in the predetermined waiting position, in case the recording medium is not properly conveyed, for example, by a trouble in the conveying system. Consequently, a prompt response to the trouble can be realized by so selecting the waiting position as not to hinder the maintenance work.

In case the recording head is an ink jet recording head, for recording by the ink jet recording process, a capping operation is desirably conducted on the ink jet recording head in the waiting position.

Such configuration enables proper protection of the recording head and also enables to maintain the recording head in a state same as before the waiting state, thereby preventing the deterioration of the recording equality even in case the recording operation is interrupted, for example, by a trouble.

Also, preferably the recording by the output means ends when the recording head passes the recording medium.

In such configuration, the conveying operation of the recording medium starts in a state where the recording head is no longer present on the recording medium. Consequently, the interference between the recording head and the recording medium can be minimized.

Also, preferably the recording by the output means ends when the recording head completes the image recording in the recording scanning operation.

Such configuration can expedite the start of conveying operation for the recording medium, so that the recording medium can be conveyed in a more secure manner by the predetermined amount by the start of next recording operation.

In another aspect of the present invention, there is provided a recording apparatus comprising recording means for causing reciprocating motions of a recording head in the main scanning direction in succession on a recording medium and causing the recording head to effect a recording operation on the recording medium during the moving period of the reciprocating motion; output means for releasing a signal for instructing the conveyance of the recording medium, at the end of the recording by the recording head in the moving period; conveying means for conveying the recording medium by a predetermined amount in the subscanning direction in response to the signal released by the output means; detection means for detecting a joint in the recording medium, in a position in front of the recording head at least by a recording width of the recording head; and passing means for inhibiting the start of motion of the recording head by the recording means at least while the joint is present in the recording scanning area, based on the detection of the joint in the recording medium by the detection means, thereby causing the joint to pass through the recording scanning area of the recording head.

The above-mentioned configuration reduces the recording time by conveying the recording medium in the period from the end of recording to the start of next recording, and, for a recording medium involving a joint, enables to detect the joint portion and to inhibit the recording on such joint portion. Also, the interference between the joint portion and the recording head can be prevented, since the motion of the recording head itself is inhibited.

In the above-mentioned configuration, the passing means is preferably provided with discrimination means for discriminating whether the joint is present in a next recording scanning area of the recording head, based on the detection of joint by the detection means, and passing conveyance means for causing the joint to pass through the recording scanning area prior to the start of next movement of the recording head by the recording means, in case the discrimination means identifies that the joint is present in the next recording scanning area.

The above-mentioned configuration inhibits the movement of the recording head and the execution of recording in the area of a recording width including the joint portion.

Preferably, the discrimination means discriminates whether the joint is detected by the detection means, at the start of execution of the recording by the recording means.

Such configuration allows to confirm the presence or absence of the joint at the completion of conveyance of a predetermined amount of the recording medium, thereby enabling stable confirmation of the joint.

Also, preferably there are further provided confirmation means for confirming the completion of conveyance by the conveying means at the start of execution of recording by the recording means and also confirming the presence or absence of detection of joint by the detection means, and inhibition means for inhibiting the execution of recording within the moving period in case the completion of conveyance is not confirmed by the confirmation means, and the passing means is adapted, based on the presence or absence of joint confirmed by the confirmation means, to inhibit the start of movement of the recording head by the recording means at least while the joint is present in the recording scanning area, thereby causing the joint to pass through the recording scanning area of the recording head.

Such configuration, in case the conveyance of a predetermined amount of the recording medium is not completed within the period from the end of recording to the start of next recording, for example, by a trouble in the conveying system for the recording medium, enables to inhibit the execution of recording in the recording scanning motion, thereby preventing the loss of the recording medium and inhibiting the movement of the recording head toward the joint.

Also, preferably the passing means is adapted, based on the detection of joint of the recording medium by the detection means, to divert the recording head to a position not interfering with the recording medium at least while the joint is present in the recording scanning area, and to inhibit the start of movement of the recording head by the recording means, thereby causing the joint to pass through the recording scanning area of the recording head.

Such configuration allows, when the joint passes the recording scanning area, to securely prevent the interference between the recording head and the joint.

According to another aspect of the present invention, there is provided a recording apparatus provided with a recording control unit for controlling the recording scanning operation of a recording head, a conveying control unit for conveying a recording medium, and a communication unit for effecting communication between the recording control unit and the conveying control unit according to a predetermined communication protocol; wherein the recording control unit comprises recording means for causing reciprocating motions of the recording head in the main scanning direction in succession on the recording medium and causing the recording head to effect a recording operation on the recording medium during the moving period of the reciprocating motion, and output means for sending, at the end of recording by the recording head in the moving period, a signal instructing the conveying operation for the recording medium to the conveying control unit through the communication unit; and the conveying control unit comprises conveying means for conveying the recording medium by a predetermined amount in the subscanning direction, in response to the signal released by the output means.

In the above-mentioned configuration, in a recording apparatus in which the recording control unit for controlling the recording and the conveying control unit for conveying the recording medium are mutually separated, the recording is executed during the forward or reverse moving period in the successively repeated reciprocating motions of the recording head under the control by the recording control unit. Then, at the end of the recording in the moving period, there is instructed the conveying operation for the recording medium, and, in response, the conveying control unit executes the conveying operation of a predetermined amount. Thus, after the end of the recording, the conveying operation of the recording medium can be completed within a period required by the recording head for deceleration, stopping and start of motion in the opposite direction, until the start of recording of a next line, so that the recording process time can be shortened.

Preferably the above-mentioned recording apparatus further comprises detection means, in the conveying control unit, for detecting a joint of the recording medium at a position in front of a recording width of the recording head, inhibition means, in the recording control unit, for inhibiting the start of movement of the recording head, based on the detection of joint of the recording medium, at least while the joint is present in the recording scanning area, and passing means, in the conveying control unit, for causing the joint to pass through the recording scanning area of the recording head while the start of movement of the recording head is inhibited by the inhibition means.

In a recording apparatus in which the recording control unit for recording control and the conveying control unit for conveying the recording medium are mutually separated, the above-mentioned configuration shortens the recording time by conveying the recording medium within the period from the end of recording to the start of next recording, and, for the recording medium having a joint, allows to detect the portion of the joint and to inhibit the recording for said joint portion. Also, there can be prevented the interference between the joint portion and the recording head, since the movement itself of the recording head is inhibited.

Other objects of the present invention, and the features and advantages thereof, will become fully apparent from the following description to be taken in conjunction with the attached drawings and also from the appended claims.

DESCRIPTION OF THE PREFERRED EMBODIMENTS

Now the present invention will be clarified in detail by preferred embodiments shown in the attached drawings.

Embodiment 1

Figure 1:
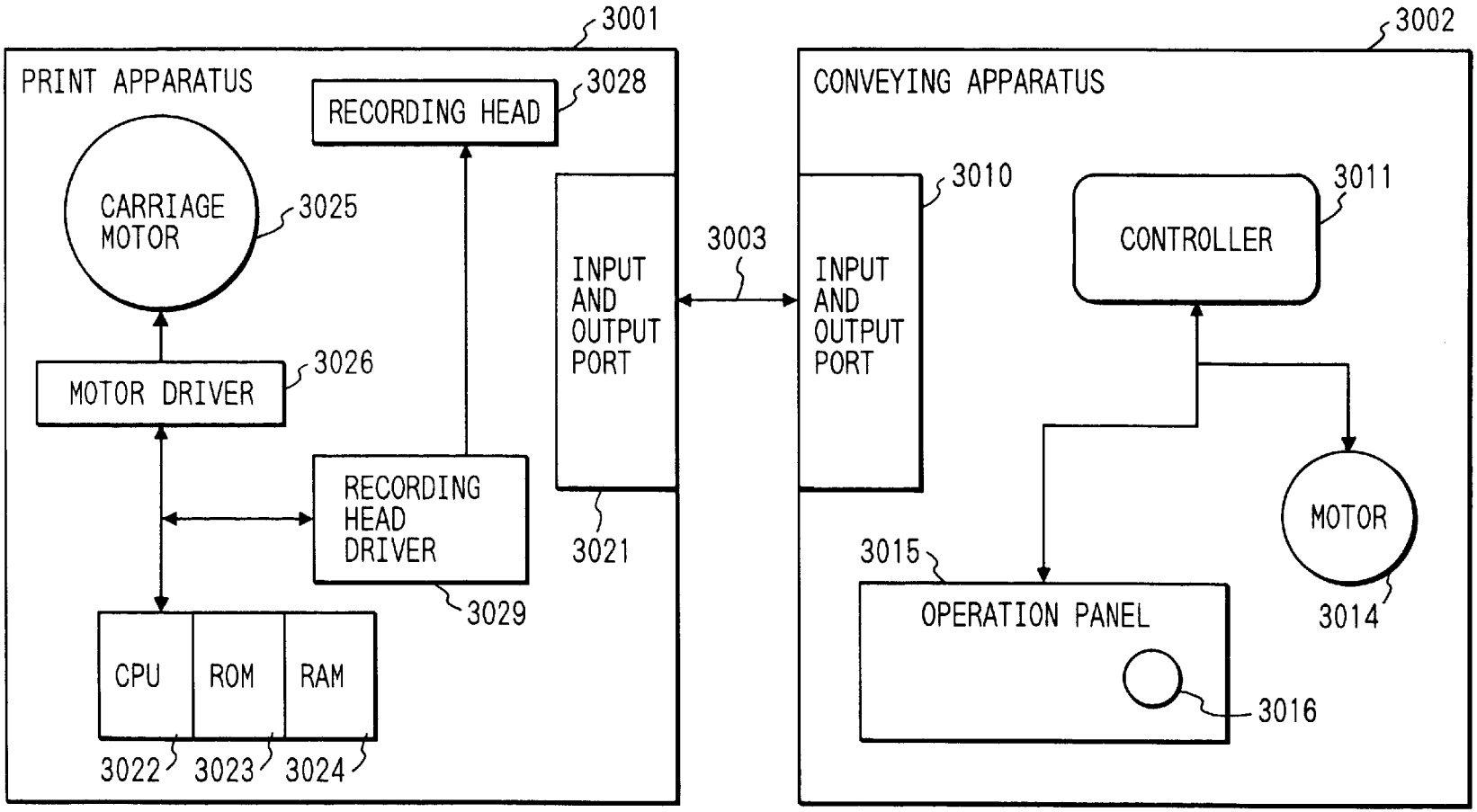
FIG. 1 is a block diagram of an ink jet recording apparatus embodying the present invention.

FIG. 1 is a block diagram showing the configuration of an ink jet recording apparatus (hereinafter simply called recording apparatus) embodying the present invention, wherein a printing apparatus 3001 and a conveying apparatus 3002 are connected by an exclusive interface 3003.

The conveying apparatus 3002, for conveying cloth or the like, is provided with an input/output port 3010 for effecting the interface with the printing apparatus 3001; a motor 3014 for conveying the cloth; and an operation panel 3015 provided with various operation switches for the operator to effect various operations, including a start switch 3016 for instructing the start of a recording operation. The operation panel 3015 is further provided with other switches (for example, a stop switch and an emergency stop switch), though they are not illustrated. A controller 3011 for controlling the conveying operation of the present conveying apparatus, is provided with a CPU (not shown), a ROM (not shown) and a RAM (not shown).

The printing apparatus 3001 is provided with an input/output port 3021 for effecting the interface; a CPU 3022 for controlling the printing apparatus 3001; a ROM 3023 for storing various control programs and data; a RAM 3024 to be used as a work area for the CPU 3022 in the execution of various controls and also for storing image data developed for the execution of recording by the recording head; a motor 3025 for reciprocating the recording head incorporated in this printing apparatus 3001; a motor driver 3026 for controlling the motor 3025; a recording head driver 3027 for controlling the recording operation of the recording head based on the image data stored in the RAM 3025; and a recording head 3028 for effecting recording onto the recording medium by the ink jet recording process, based on the drive signal from the recording head driver 3027.

Figure 2:
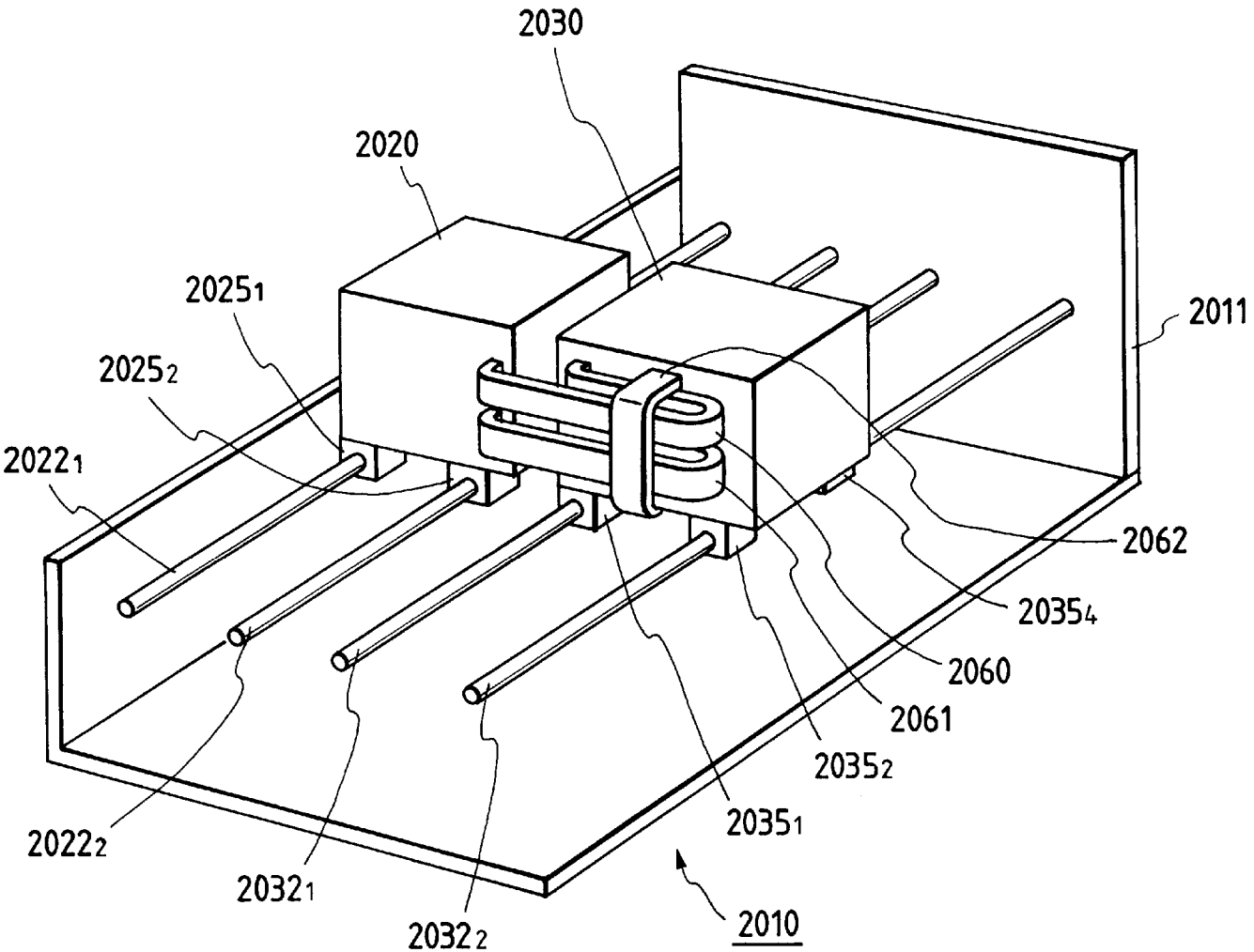
FIG. 2 is a view showing the details of a recording unit in a printing device.

FIG. 2 is a view showing the details of a recording unit in the printing apparatus 3001, which is provided with an ink jet recording unit as shown in FIG. 2. A main body 2011 supports, by rails 2022, a head carriage 2020 on which a recording head is mounted. The head carriage 2020 is connected to a driving motor (not shown) through a driving belt (not shown). In the present embodiment, the driving motor is composed of a stepping motor, but a motor of another type may be used for this purpose. The driving motor is connected to signal lines therefor, through a motor driver board (not shown) of the printing apparatus. The motor driver board sends drive signals to the motor in response to instructions from the CPU, thereby effecting motor control such as stopping or starting of the motor or speed control matching the characteristics of the head.

The head carriage 2020 moves along the rails by the drive of the motor, and effects recording according to the image data. An ink tank carriage 2030 also moves together with the head carriage 2020. The ink tank carriage 2030 and the head carriage 2020 are mutually connected by a bundle 2060 of electric cables and a bundle 2061 of ink tubes.

In the following, there will be explained the function of the conveying apparatus and the printing apparatus of the present invention in the actual printing operation.

Figure 3:
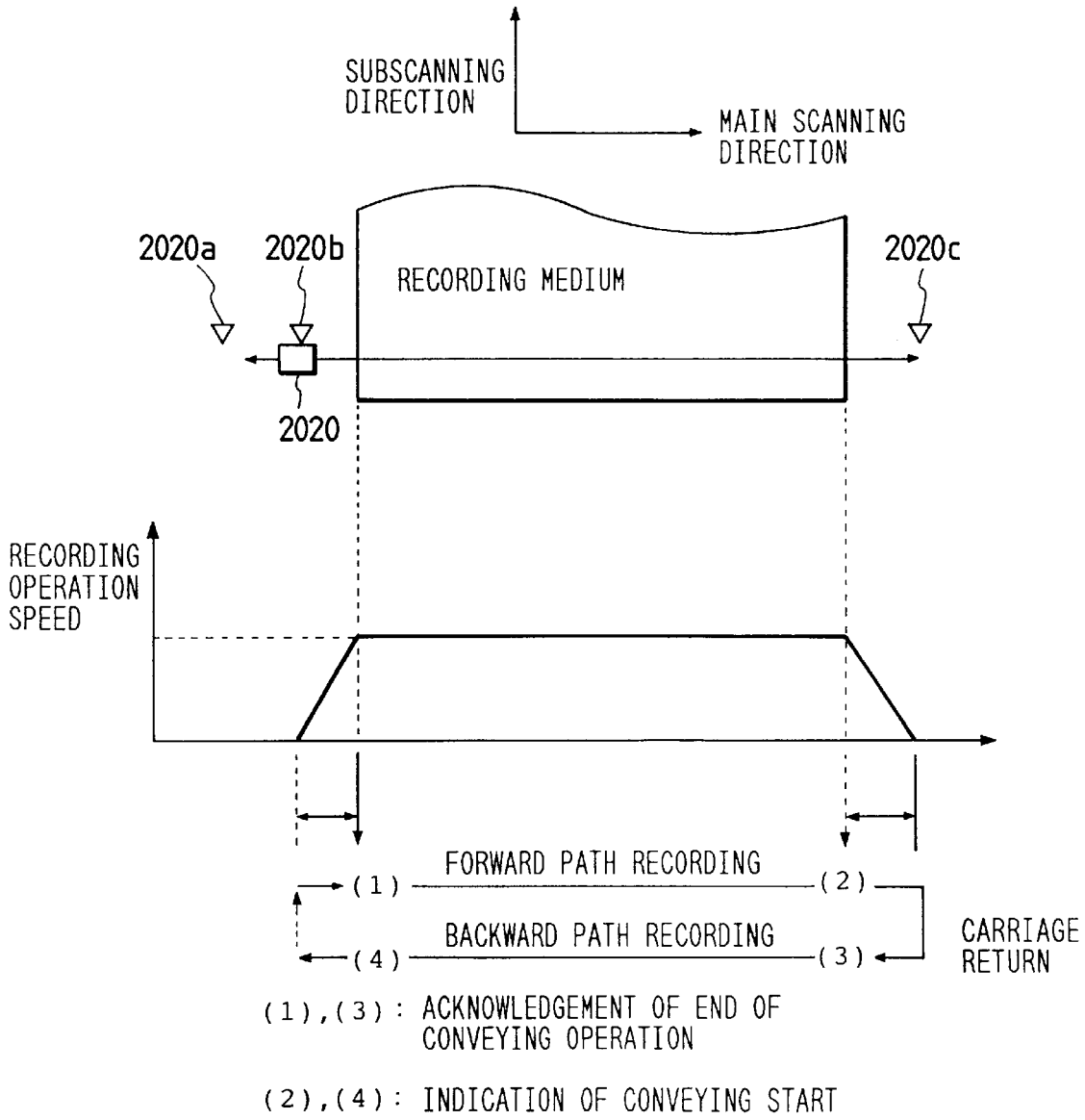
FIGS. 3 and 4 are timing charts indicating the recording scanning operation of the recording head and the conveying operation for the recording medium in the embodiment.

FIG. 3 is a chart showing the timings of the recording scanning operation of the recording head and the conveying operation of the recording medium in the present embodiment. The head carriage 2020 effects reciprocating motions on the recording medium. As explained in the foregoing, the ink tank carriage 2030 moves together with the head carriage. A sensor 2020*a* is provided for detecting that the head carriage 2020 s in a waiting position. Sensors 2020*b* and 2020*c* are provided for detecting that the head carriage 2020 has reached a returning point in the reciprocating motion. It is also possible to use a single sensor for the sensors 2020*a* and 2020*b*.

The head carriage starts forward movement from the position of the sensor 2020*b*, and reaches the recording speed upon arriving at the recording medium (position (1)). At this point the printing apparatus 3001 confirms that the conveying operation of the recording medium by a predetermined amount in the subscanning direction, by the conveying apparatus 3002, has been completed. Then, the printing apparatus 3001 executes the recording in the forward movement, and, upon arrival of the head carriage 2020 at the other end of the recording medium (position (2)), instructs the conveying apparatus 3002 to start the conveying operation of the recording medium.

Thereafter the head carriage 2020 is gradually decelerated and stops upon arrival at the position of the sensor 2020*c*, and starts the movement in the reverse direction immediately thereafter. The head carriage 2020 is gradually accelerated and reaches the recording speed upon arrival at the recording medium (position (3)). At this point, as in the forward motion explained above, there is confirmed the completion of conveying operation of the recording medium by the predetermined amount, by the conveying apparatus 3002. Then the printing apparatus effects the recording in the reversing motion, and, upon arrival of the head carriage 2020 at the other end of the recording medium (position (4)), instructs the conveying apparatus 3002 to convey the recording medium. Then the head carriage 2020 is gradually decelerated, stops at the position of the sensor 2020*b* and immediately thereafter starts the recording operation in the forward direction as explained above.

The conveying apparatus 3002 receives the instruction for starting the conveying operation of the recording medium from the printing apparatus 3001 at the above-mentioned timing (2) or (4) and moves the recording medium in the subscanning direction by a predetermined amount (corresponding to the recording width of the recording head). The movement of the recording medium by the predetermined amount is completed within the period of deceleration, stopping, start of reversing and acceleration until the arrival at the recording medium (i.e. from (2) to (3) and from (4) to (1)). Thus the recording process speed increases, as the conveyance of the recording medium is completed while the recording head executes the operations necessary for the reversing of the moving direction.

Figure 4:
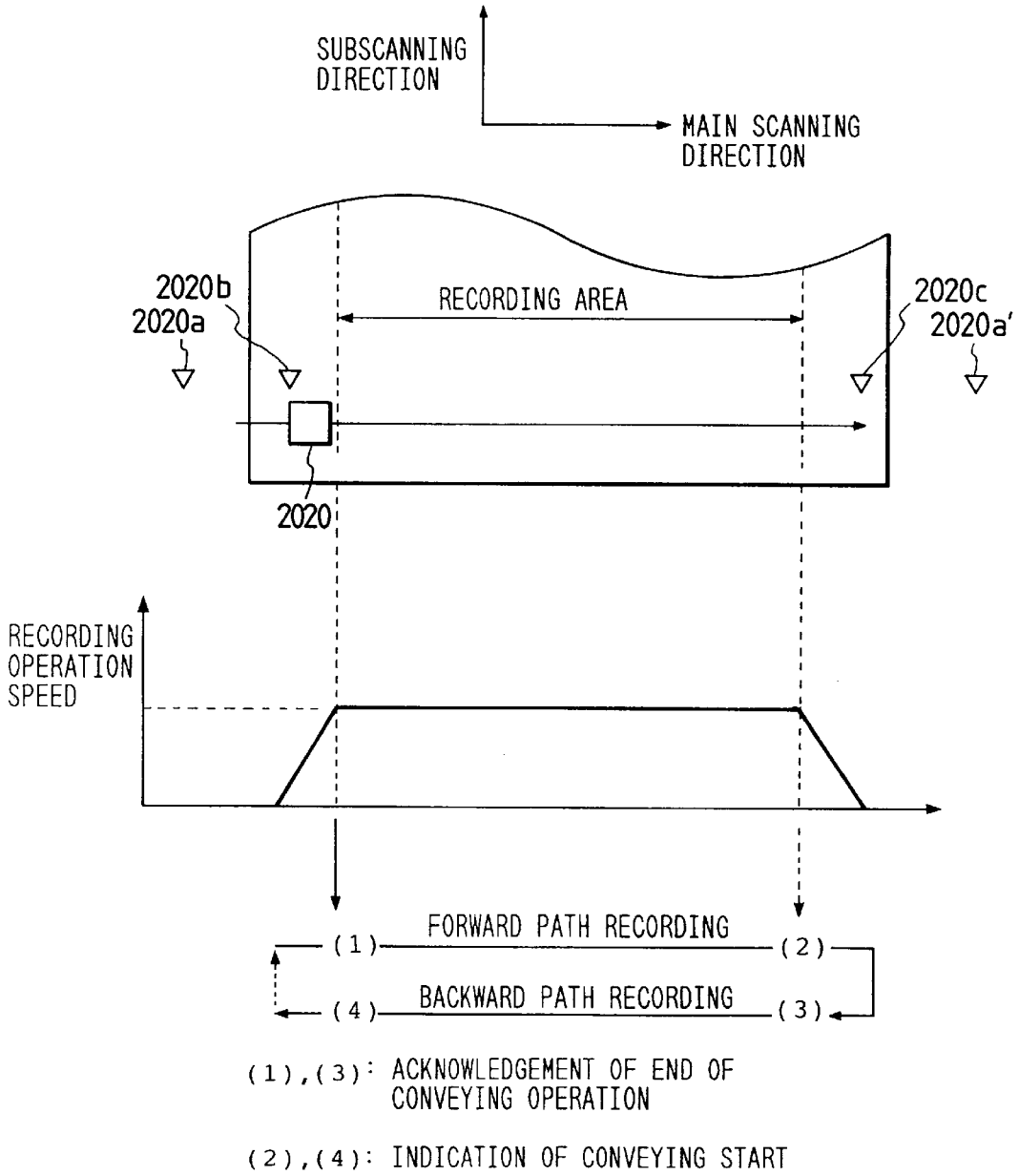

Also in the configuration shown in FIG. 3, the positions (1) to (4) may also be taken at both ends, in the main scanning direction, of the recording area in which the image is to be recorded. Such case is illustrated in FIG. 4, which shows another example of the timing of the recording scanning operation of the recording head and of the conveying operation of the recording medium. In such case, as shown in FIG. 4, the returning positions (corresponding to the sensors 2020*b* and 2020*c*) of the head carriage 2020 may be in the non-recording areas on the recording medium. Such configuration can achieve a further increase in the recording process speed as the conveying operation is started as soon as the head carriage passes through the recording area, so that the period in which the head carriage moves in the non-recording area on the recording medium can be utilized for the conveyance of the recording medium. However, the waiting position of the sensor 2020*a* is desirably located outside the recording medium.

Figure 5:
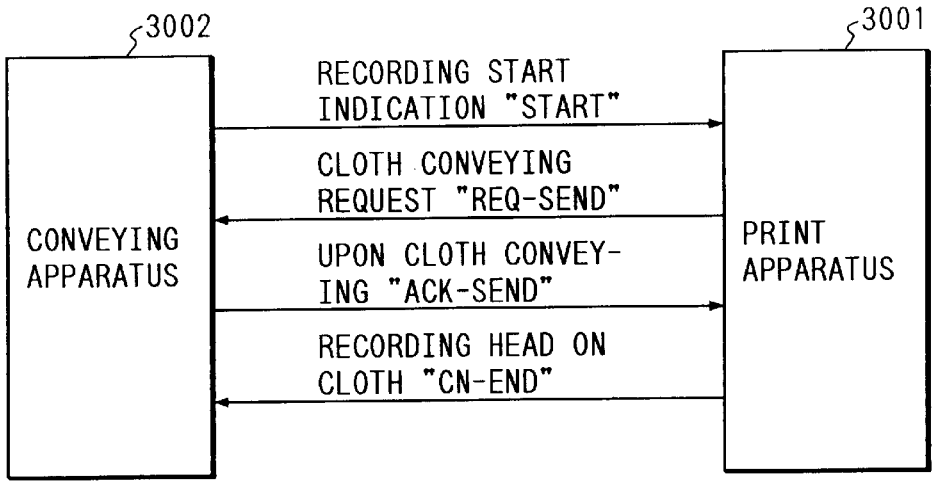
FIG. 5 is a view showing the content of communication relating to the conveying operation for the recording medium between the printing device and the conveying device in the first embodiment.

FIG. 5 shows the content of communication between the printing apparatus 3001 and the conveying apparatus 3002 of the first embodiment, relating to the conveying operation for the recording medium. The present embodiment employs cloth as the recording medium, but there can naturally be utilized recording media of other materials. An instruction START for starting the recording is supplied, in response to the depression of the start switch 3016 of the conveying apparatus 3002, to the printing apparatus 3001. A request signal REQ-SEND for cloth conveying is supplied, at the positions (2) and (4) shown in FIG. 3, from the printing apparatus 3001 to the conveying apparatus 3002. A signal ACK-SEND indicates that the conveying apparatus 3002 is in the course of cloth conveying. A signal CN-END indicates that the head carriage 2020 is present on the cloth, and is used, particularly in an apparatus having the positional relationship as shown in FIG. 4, for discriminating whether the recording head is in the escape position corresponding to the sensor 2020*a*.

The above-explained operations will be explained further with reference to flow charts in FIGS. 6 to 10, showing the sequence of recording operation in the present embodiment.

Figure 6:
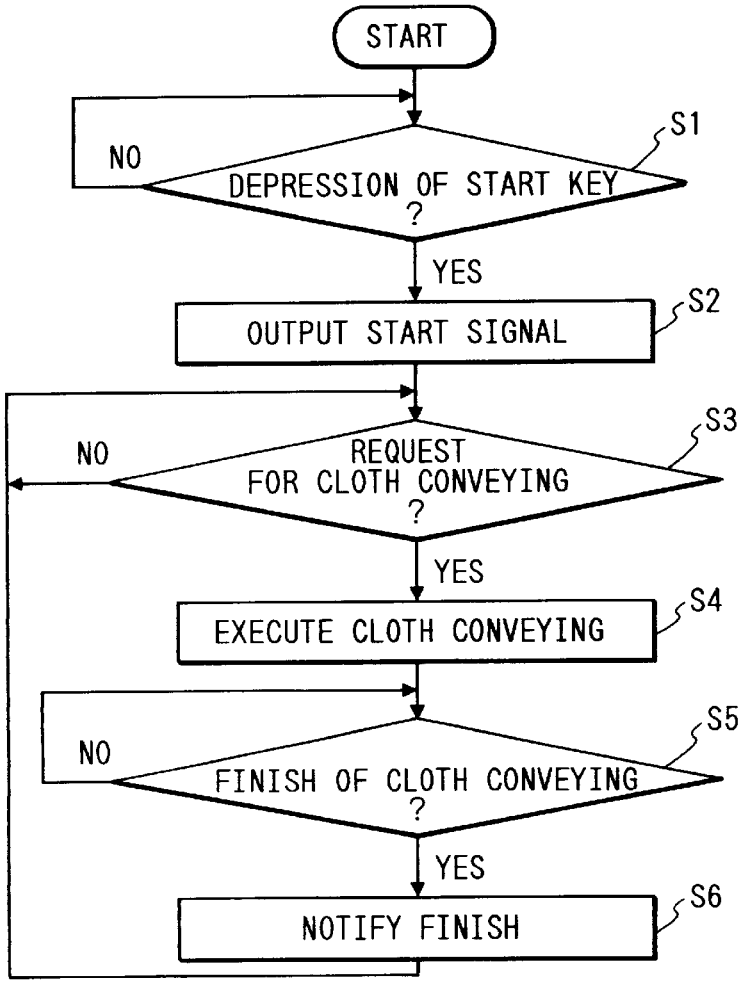
FIGS. 6 to 10 are flow charts showing the sequence of recording operation in the first embodiment.
Figure 7:
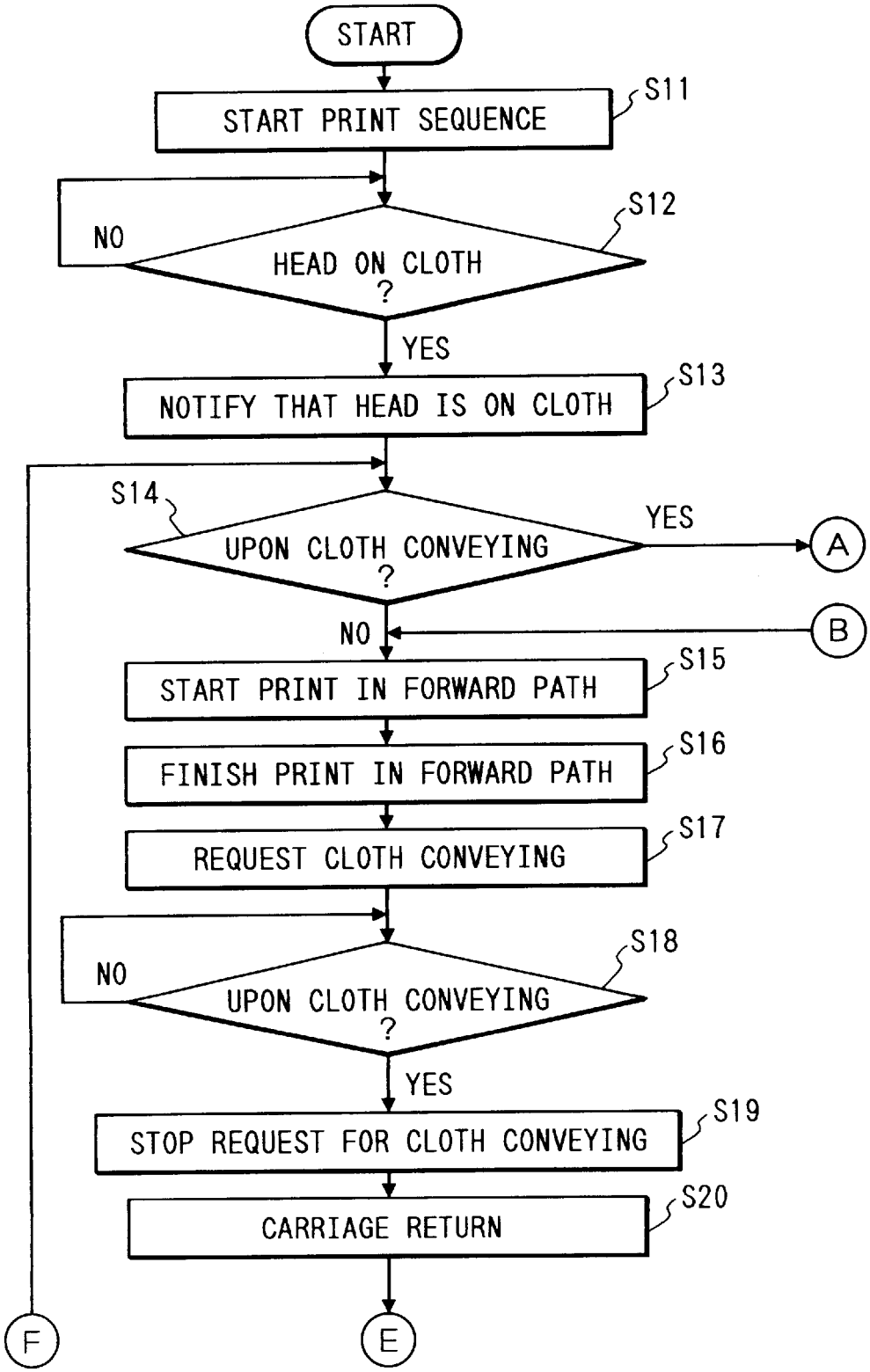
Figure 8:
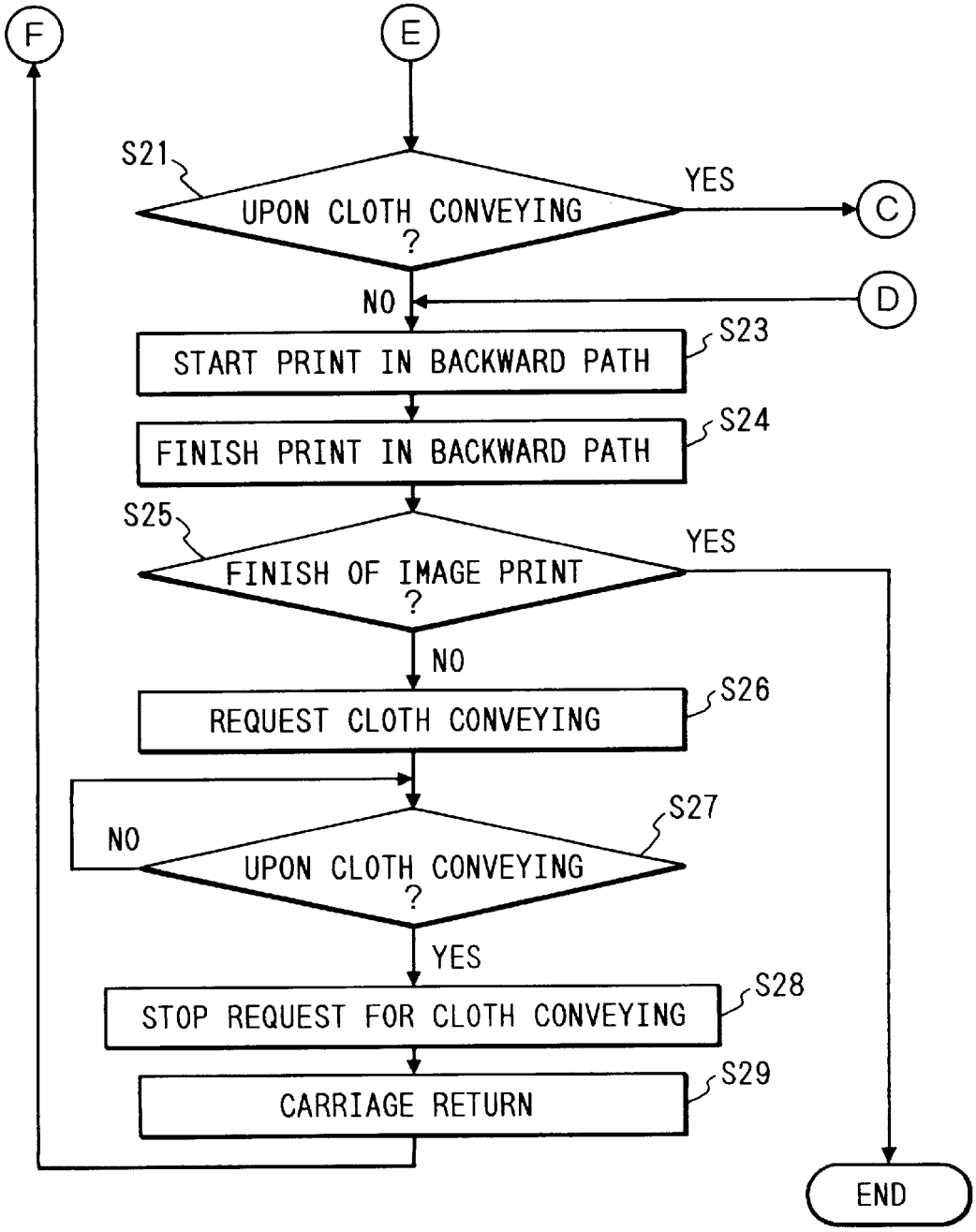

At first referring to FIG. 6, when the start key 3016 in the operation panel 3015 of the conveying apparatus 3002 is depressed in a step S1, the sequence proceeds to a step S2 in which the conveying apparatus 3002 releases a signal START for instructing the printing apparatus 3001 to start the printing operation. Then a step S3 awaits a cloth conveying request signal REQ-SEND from the printing apparatus 3001.

In response to the START signal, the printing apparatus 3001 activates a sequence shown in FIGS. 7 to 10. The print sequence is initiated in a step S11 in FIG. 7, and a step S12 discriminates whether the recording head is present on the cloth, and, if not, the recording head is moved onto the cloth, and a step S13 informs the conveying apparatus 3002 that the recording head is present on the cloth (i.e. the recording head has reached the recording start position), by the shift of the ON-END signal to the high-level state in the present embodiment.

Then a step S14 discriminates whether the conveying apparatus 3002 is in the course of cloth conveying operation (position (1) in FIGS. 3 and 4). In the present embodiment, if the ACK-SEND signal is in the low-level state, the cloth conveying operation is identified as not in progress, and the sequence proceeds to a step S15 to initiate the printing operation in the forward movement. When the forward printing operation is terminated in a step S16, a step S17 sends a cloth conveying request signal REQ-SEND to the conveying apparatus 3002 (position (2) in FIGS. 3 and 4). When the start of the cloth conveying by the conveying apparatus 3002 is confirmed, a step S18 turns off the cloth conveying request signal REQ-SEND.

Subsequently, the printing apparatus 3001 gradually decelerates the carriage moving motor 3025 to stop the carriage at a predetermined position (corresponding to the position of the sensor 2020*c*). Then, a step S20 activates the motor 3025 to reverse the carriage and to effect the printing operation in the reverse movement.

On the other hand, the conveying apparatus 3002 executes the cloth conveying in a step S4 (FIG. 6), upon reception of the cloth conveying request signal REQ-SEND, released in the aforementioned step S17, through the interface 3003 and the input/output port 3010. Also, a signal indicating that the cloth conveying is in progress (by the high-level state of the ACK-SEND signal) is supplied to the printing apparatus 3001. Then, a step S5 awaits the completion of the cloth conveying operation. Upon completion of the operation, a step S6 informs the printing apparatus 3001 of the completion of the cloth conveying (by the low-level state of the ACK-SEND signal).

On the other hand, in the printing apparatus 3001, the carriage has already been moved in the reverse direction in the step S20, and a step S21 confirms, by the ACK-SEND signal, whether the cloth conveying has been completed when the recording head reaches the recording start position (or reaches the cloth, i.e. the position (3) in FIGS. 3 and 4). If the cloth conveying has been completed, the sequence proceeds to a step S23 (FIG. 8) to start the recording operation in the reverse motion. When the reverse printing operation is completed in a step S24 (i.e. at the end of the recording period, corresponding to (4) in FIGS. 3 and 4), a step S25 discriminates whether the printing of an entire image has been completed. If completed, the present sequence is terminated, but, if not, there are executed steps S26, S27, S28 and S29 similar to the steps S17 to S20 to start the recording operation in the forward movement.

Figure 9:
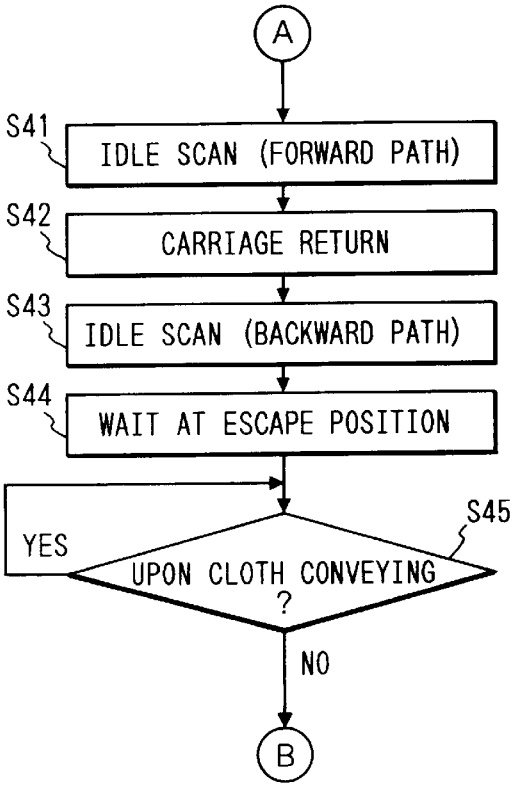

In the following there will be explained, with reference to FIG. 9, the sequence in case the conveying apparatus is in the conveying operation at the start of the forward recording operation. In case the step S14 in FIG. 7 identifies that the conveying apparatus is in the course of the cloth conveying operation, a trouble in the conveying apparatus is identified and the sequence proceeds to a step S41 which executes an idle scanning motion of the carriage without execution of the recording in the forward motion. Upon completion of the forward idle scanning, a step S42 reverses the carriage and a step S43 executes an idle scanning operation also in the reverse movement. Then a step S44 moves the carriage to a predetermined escape position (corresponding to the sensor 2020*a* in FIGS. 3 and 4) and causes the carriage to wait. In this waiting position there is provided a mechanism for capping, so that the recording head can be maintained in a state same as before the waiting. Then the sequence of the printing apparatus 3001 proceeds to a step S45 to wait for the completion of the cloth conveying operation in the conveying apparatus 3002. Upon completion of the cloth conveying operation, the sequence returns to the step S15 in FIG. 7 to re-start the printing operation in the forward movement.

Figure 10:
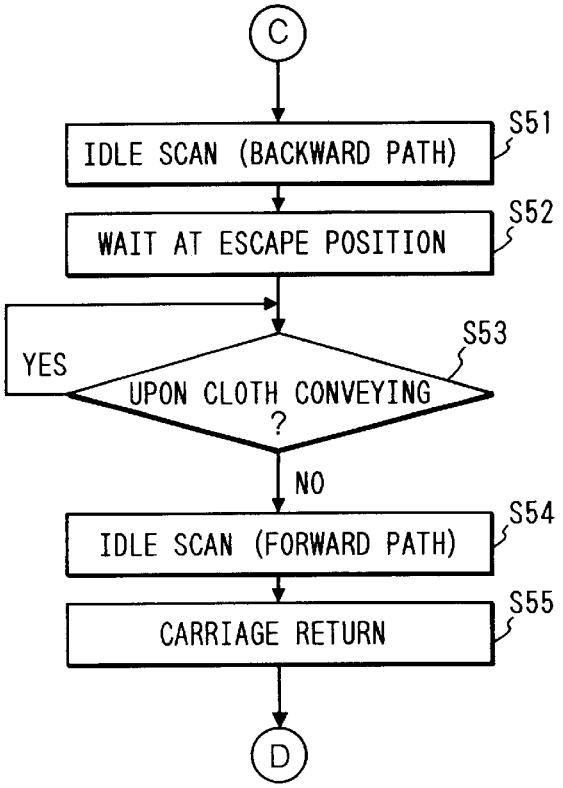

In the following there will be explained, with reference to FIG. 10, the sequence in case the step S21 identifies that the cloth conveying operation is in progress at the start of the reverse recording operation. A step S51 executes an idle scanning operation in the reverse movement, and a step S52 causes the carriage to wait in the aforementioned waiting position. Then a step S53 waits for the completion of the cloth conveying operation in the conveying apparatus, then, upon completion, a step S54 executes an idle scanning operation in the forward movement, a step S55 reverses the carriage and the sequence then returns to the step S23. In this manner the printing operation in the reverse movement is restarted.

In the present embodiment, as explained in the foregoing, the carriage is not unnecessarily stopped but is driven in synchronization with the conveying apparatus, whereby high-speed printing is enabled. Particularly in the present embodiment, the cloth conveying is normally completed, after the release of the cloth conveying request signal, in a period of deceleration, stopping, reversing and acceleration of the carriage until the printing operation is restarted. Consequently, there is scarcely utilized the conventional step-by-step sequence in which the cloth conveying is started after the recording head is stopped and the movement of the recording head is started after the completion of cloth conveying operation is confirmed. Also in case such step-by-step sequence is started or in case of a trouble of the conveying system, the recording head waits in the capped state so that the printed image can be obtained in the same state as before the interruption of the printing operation and the printing operation can therefore be conducted in continuous manner.

Also the efficiency of the works for example in case of a trouble can be improved by selecting the escape position of the head carriage 2020 (corresponding to the position of the sensor 2020*a*) so as not to hinder the maintenance work for the conveying mechanism.

Embodiment 2

In the recording apparatus as explained in the foregoing embodiment 1, the cloth used as the recording medium may be supplied from a roll. In case large-sized cloth is supplied from a roll in continuous manner, such cloth cannot be usually obtained as a single piece but often contains joints. In such joint portion, the cloth often fluctuates in the thickness, so that the ink discharge face of the recording head may come into contact with such joint of the cloth. Such drawback particularly occurs, in the embodiment 1, in case the reversing point of the head carriage is present on the recording medium, as shown in FIG. 4. The present embodiment 2 is to provide a recording apparatus capable of resolving such drawback.

In the embodiment 2, the printing apparatus and the conveying apparatus are same in structure as those in the embodiment 1 (shown in FIGS. 1 and 2) and will not, therefore, be explained further. Also the positional relationship of the recording head and the sensors is same as shown in FIG. 4. In the embodiment 2, however, a sensor 2020*a* is provided at the escape position at the side of the returning path, and another sensor 2020*a*' is provided at the escape position at the side of the forward path. The sensors 2020*a*, 2020*a*' are naturally provided in positions where the recording head does not interfere with the recording medium.

Figure 11:
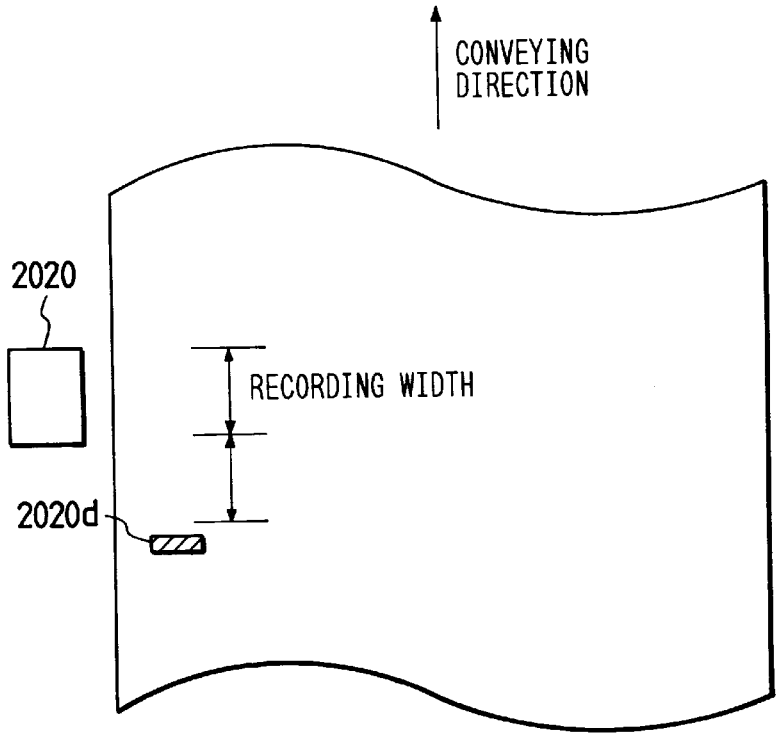
FIG. 11 is a view showing the arrangement of a joint detecting sensor in the second embodiment.
Figure 12:
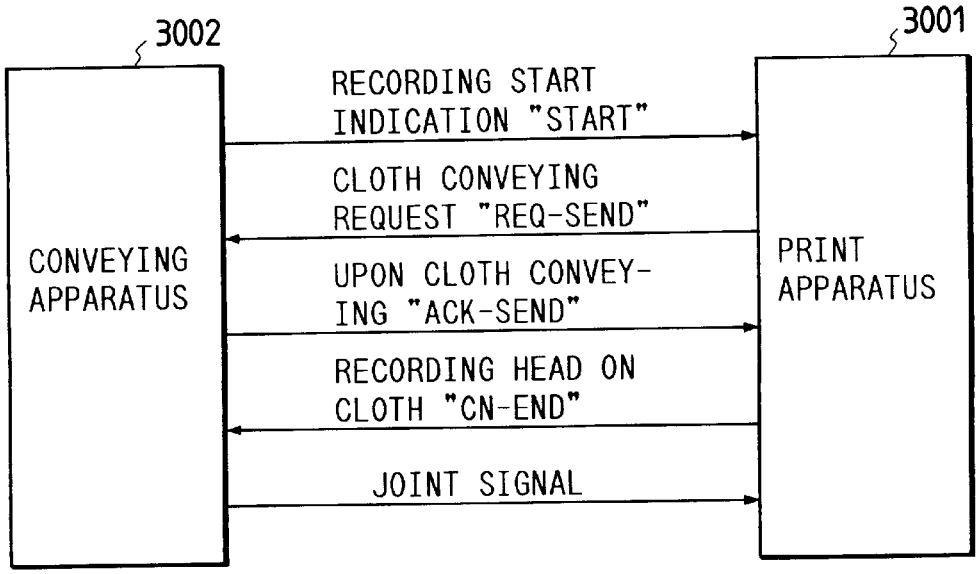
FIG. 12 is a view showing the content of communication relating to the conveying operation for the recording medium between the printing device and the conveying device in the second embodiment.

FIG. 11 is a view showing the arrangement of a joint detection sensor. A sensor 2020*d*, for detecting the joint, is provided in a position on the recording medium before printing, in front of the position of the recording head (head carriage 2020) by a distance larger than the printing width thereof. FIG. 12 shows the content of communication, relating to the conveying operation of the recording medium, between the printing apparatus 3001 and the conveying apparatus 3002 of the embodiment 2. In the communication in the present embodiment 2, there is provided a signal line to be used by the conveying apparatus 3002 for informing the printing apparatus 3001 of the detection of the joint of the recording medium.

Figure 13:
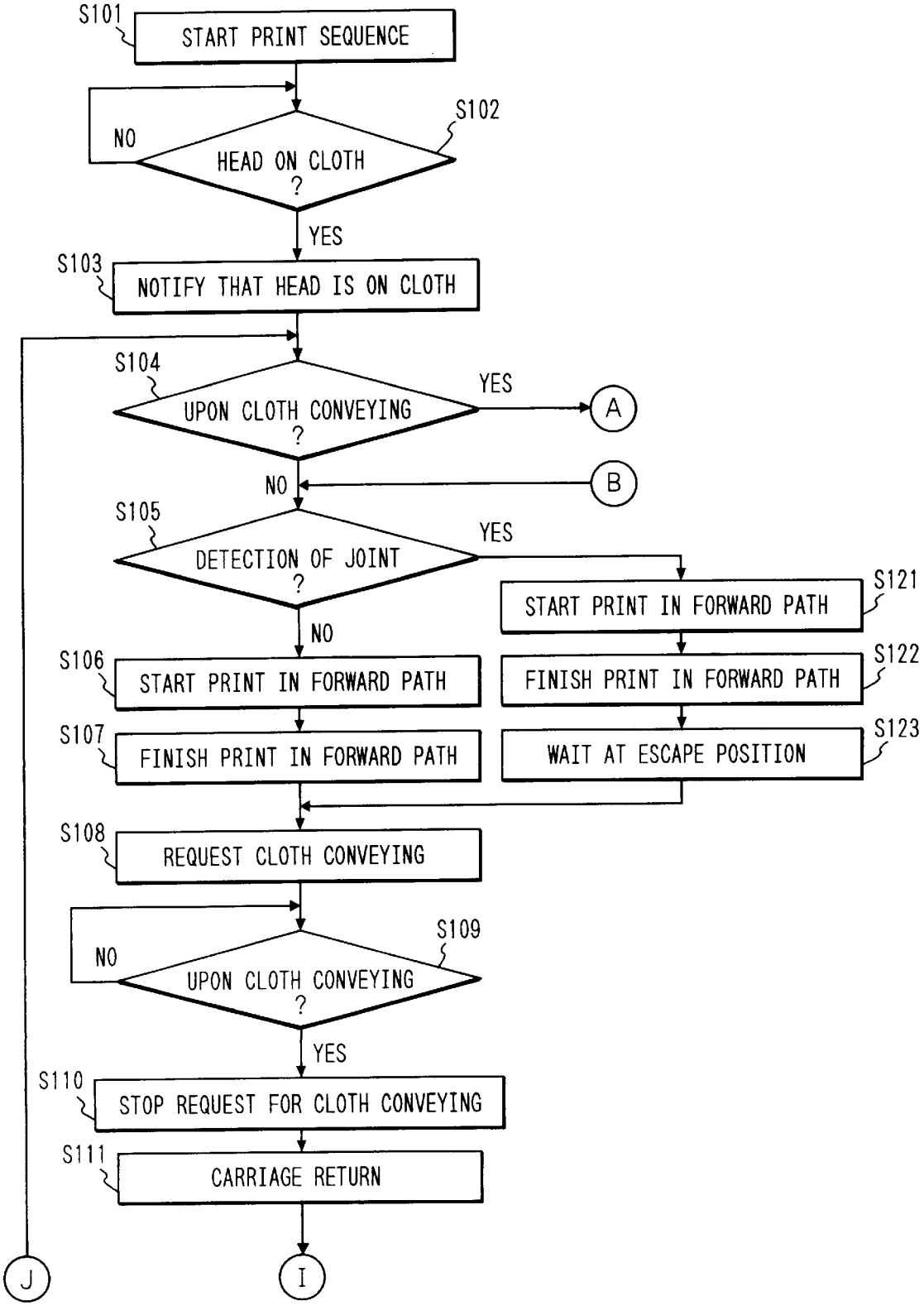
FIGS. 13 and 14 are flow charts showing the recording operation in the second embodiment.
Figure 14:
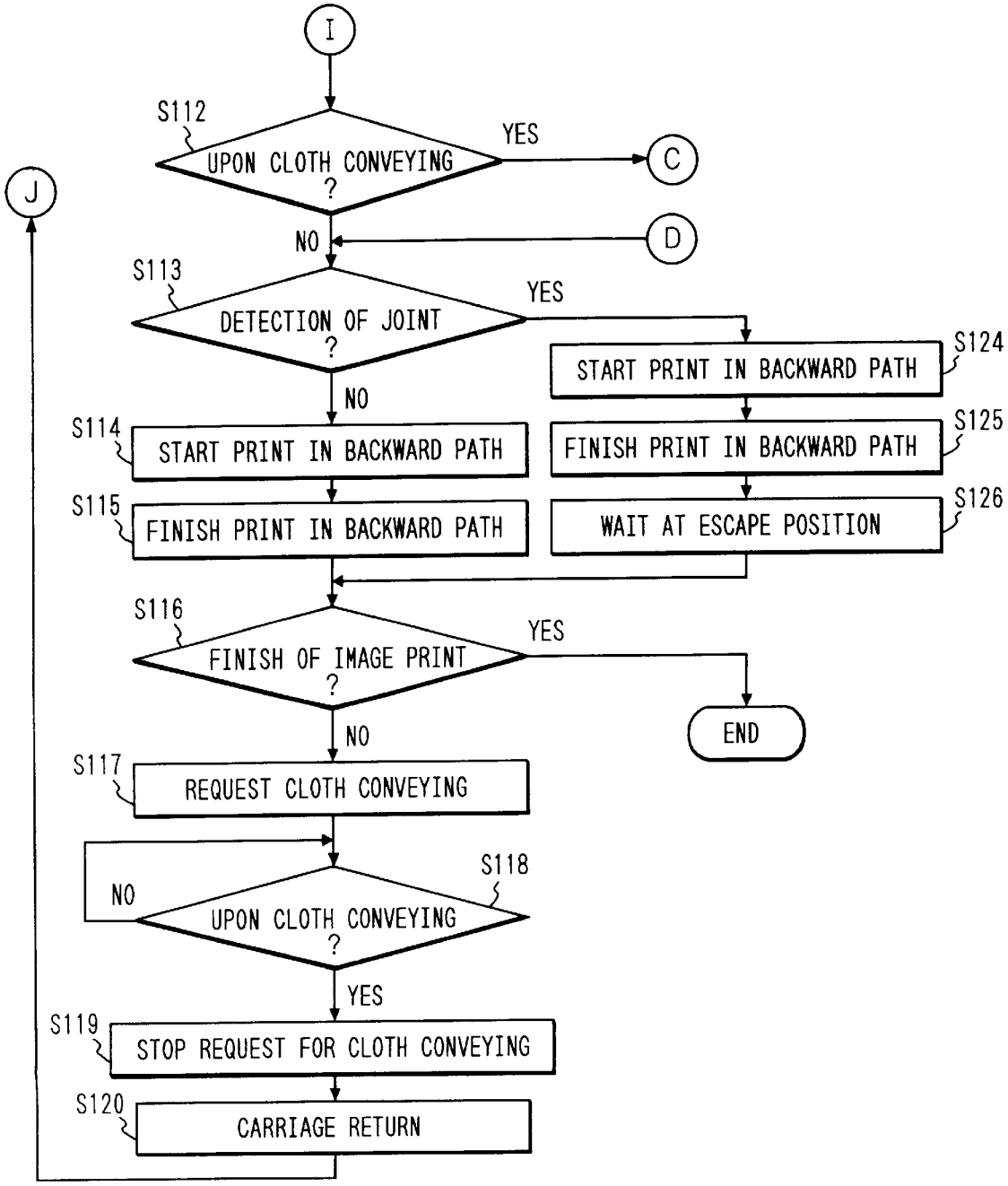

In the following the operations of the embodiment 2 will be explained in detail with reference to FIGS. 13 to 15 which are flow charts showing the recording sequence of the printing apparatus of the embodiment 2.

The printing apparatus 3001 initiates the printing sequence in response to the depression of the start key 3016. After steps S102, S103 and S104 which are same as the steps S12 to S14 in the embodiment 1, a step S105 effects detection of the joint, by confirming a joint signal from the conveying apparatus 3002. If the joint signal has not been sent from the conveying apparatus 3002, there are executed steps S106 to S112 (same as the steps S15 to S22) to effect the forward printing operation, and the reverse printing operation is conducted in succession. A step S113 confirms the joint signal, and, if the joint signal has not been sent, the sequence proceeds from a step S114 to S115. After the printing operation is terminated in the step S115, a step S116 discriminates whether the image has been completed, and, if completed, there are executed steps S118 to S120 and the forward printing operation is initiated.

In the following there will be explained the sequence in case a joint is detected in the step S105. Upon detection of a joint in the step S105, the sequence proceeds to a step S121 to effect the forward printing operation. Upon completion of the forward printing operation in a step S122 the carriage is moved to a position not hindering the conveying operation of the cloth (position of the sensor 2020*a*') and enters a waiting state. In this state the absence of the recording head on the cloth is informed to the conveying apparatus (by the high-level state of the CN-END signal). Upon confirming the absence of the carriage on the cloth, the conveying apparatus 3002 conveys the cloth to a position where the joint does not hinder the printing operation. The printing apparatus 3001, while maintaining the carriage in said waiting position, awaits the completion of the conveying of the joint portion by the conveying apparatus 3002. Having completed the conveying operation, the conveying apparatus 3002 provides the printing apparatus 3001 with a conveying completion signal (low-level state of the ACK-SEND signal) and cancels the joint signal. The printing apparatus 3001 restarts the printing operation after confirming the completion of the conveying operation and the cancellation of the joint signal.

Operations of steps S124 to S126 in case the joint is detected in the step S113 are similar to those of the aforementioned steps S121 to S123, though the escape position of the recording head is opposite, across the recording medium, to the escape position in the forward position (thus corresponding to the sensor 2020*a*).

Figure 15:
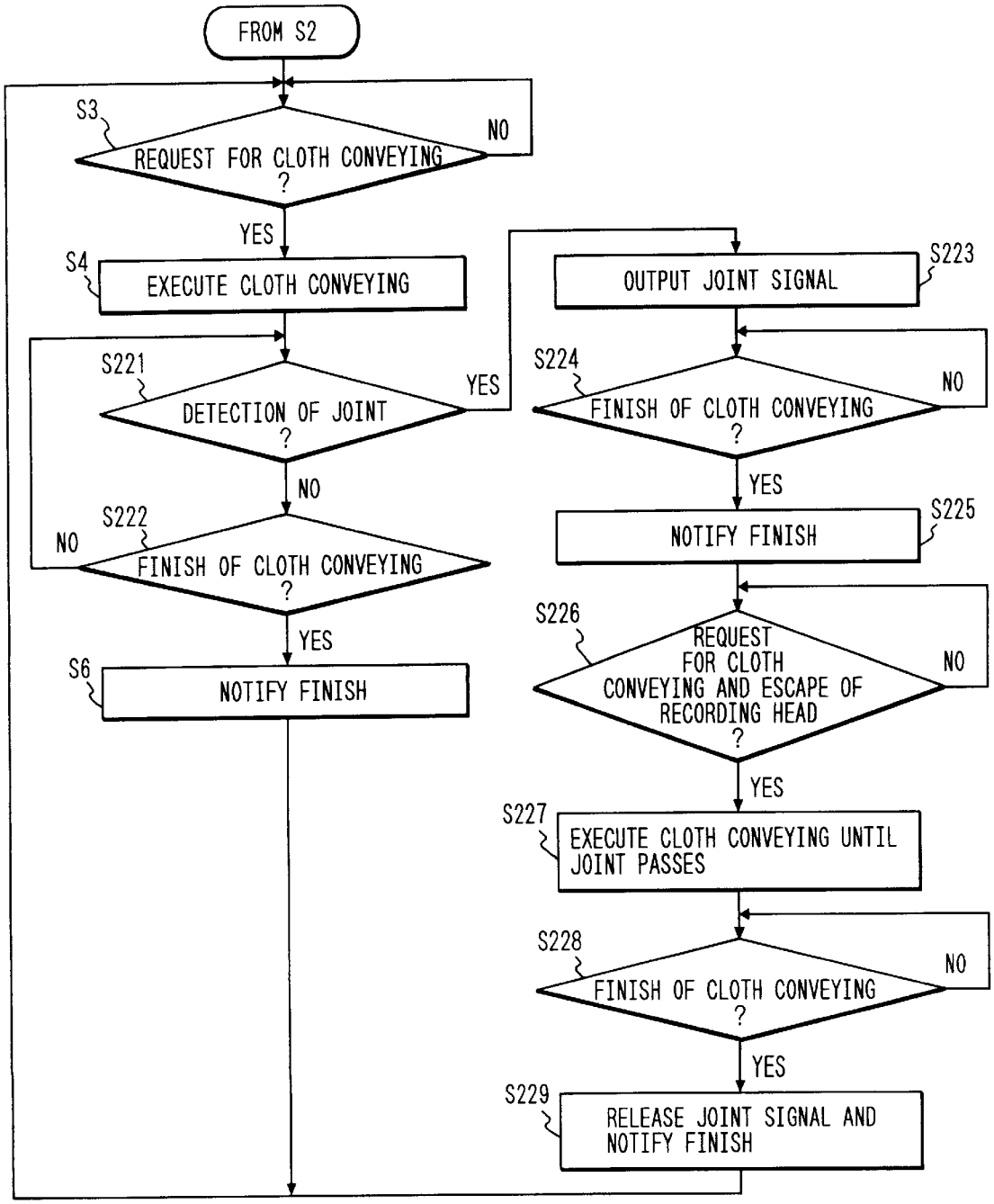
FIG. 15 is a flow chart showing the operation sequence of the conveying device in the second embodiment.

FIG. 15 is a flow chart showing the operation sequence of the conveying apparatus of the embodiment 2. In response to the cloth conveying request from the printing apparatus 3001, the conveying apparatus 3002 starts the cloth conveying operation and sets the ACK-SEND signal (steps S3 and S4). Then, during the conveying of the cloth for a predetermined amount, it detects the joint by the sensor 2020*d* (steps S221 and S222). If the cloth conveying operation is completed without the detection of joint, the sequence proceeds to a step S6 to terminate the cloth conveying operation and to inform the printing apparatus 3001 of the completion of the cloth conveying (by resetting of the ACK-SEND signal).

On the other hand, if a joint is detected by the sensor 2020*d* in the course of the cloth conveying, the sequence proceeds from the step S221 to S223 for providing the printing apparatus 3001 with a joint signal, indicating the detection of the joint. Thereafter, upon completion of the conveying operation of the predetermined amount, the completion thereof is informed by resetting of the ACK-SEND signal. The printing apparatus, as explained in the foregoing, moves the recording head to the predetermined escape position and releases the cloth conveying request signal. Thus a step S226 confirms the cloth conveying request signal REQ-SEND and the signal CN-END, indicating the absence of the recording head on the cloth, and then a step S228 executes the conveying operation in order to pass the detected joint through the recording area. Then, when the completion of the conveying operation is confirmed in a step S228, a step S229 cancels the signal ACK-SEND indicating that the cloth conveying operation is in progress and the joint signal, to the printing apparatus 3001.

In the embodiment 2, as explained in the foregoing, the joint in the cloth is detected in front of the recording head by at least a scanning width thereof. Consequently, even if the recording head has already started movement at the detection of the joint, there can be executed the printing operation in the movement, and the passing of the joint can be conducted in the cloth conveying operation next to the joint detection. Thus, in the present embodiment 2, the movement of the recording head can be initiated without awaiting the completion of the cloth conveying operation, even when the cloth contains a joint.

Figure 16:
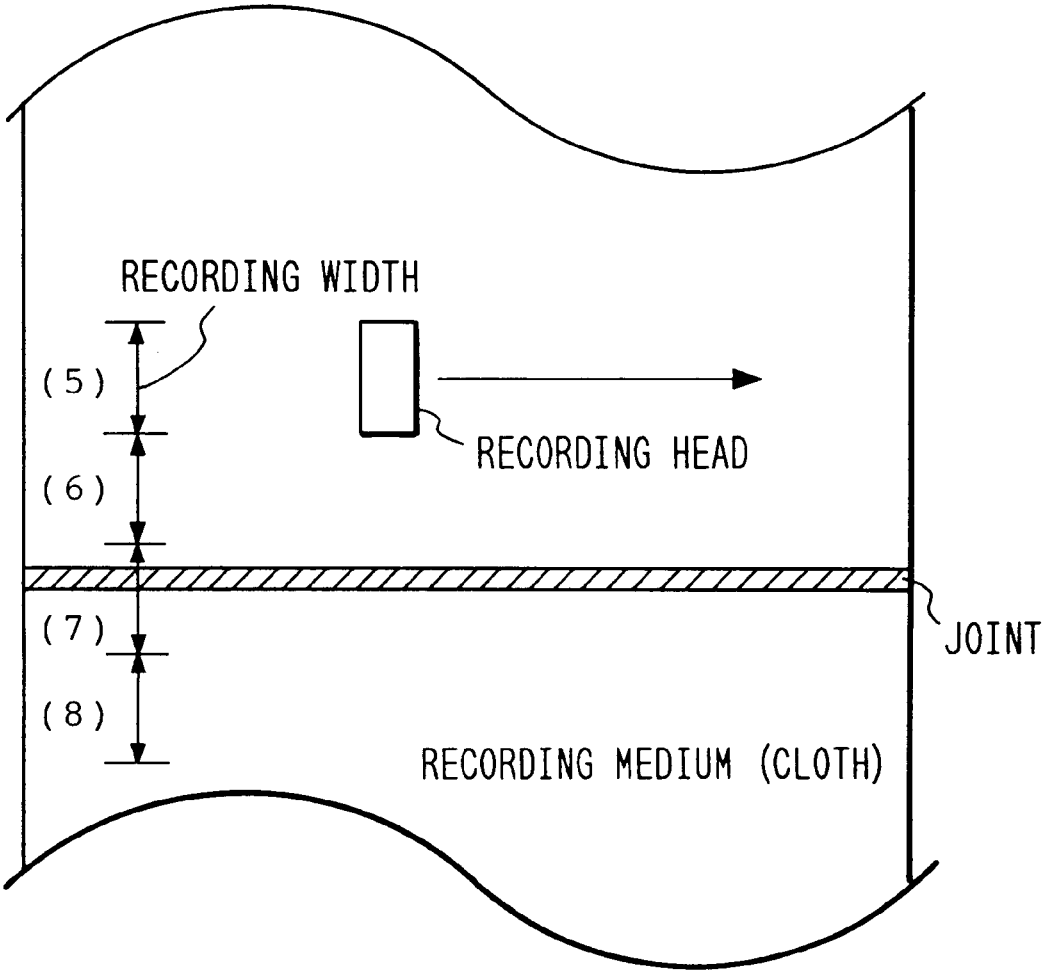
FIG. 16 is a view showing the skipping of recording scanning operation in a joint portion.

In the present embodiment 2, the joint detecting sensor effects the joint detection at a position where the printing apparatus 3001 can still execute the printing of at least a line, and the recording is executed for at least a line after the detection of the joint, so that there can be prevented the unnecessary interruption of the image at the joint portion. This mode of operation will be explained with reference to FIG. 16, illustrating the skipping of recording scanning operation at the joint portion. In the conventional method, upon detection of a joint, the joint portion is conveyed and then the printing operation is continued. In this method, if the joint is detected after the printing of a line (5), the recording medium is conveyed so as to print in a portion (8), skipping portions (6) and (7). Consequently, the portion (6) remains as blank, though the printing can in fact be made in the portion (6). On the other hand, in the present embodiment 2, the recording scanning operation is conducted for at least a line even after the detection of the joint, so that the portion (6) can be securely printed. Consequently, in the conventional method, the printed image is separated at the joint even in case the image is to be completed by one more line, but the present embodiment 2 can prevent such situation since at least a line can be printed after the joint detection.

The joint sensor may also be so positioned as to enable printing of several scanning lines. In such case it is possible to identify the number of printable lines after the detection of the joint, by identifying in advance the distance from the recording head to the sensor, and the printing can be realized without the unnecessary blank lines as explained above.

The present invention is applicable to recording apparatus to be employed for printing on various print media, and, particularly in case of ink jet printing on cloth, such cloth is required:

1) to develop the color of the ink with a sufficiently high density;
2) to show a high fixation rate of the ink;
3) to achieve rapid drying of the ink on the cloth;
4) to show little irregular ink blotting; and
5) to be easily conveyable in the apparatus.

For meeting these requirements, in the present invention, the cloth may be subjected, if necessary, to a pretreatment in advance. For example, the Japanese Patent Laid-open Application No. 62-53492 discloses cloth having an ink-receptive layer, and the Japanese Patent Publication No. 3-46589 proposes cloth containing an anti-reducing agent or an alkaline substance. Such pre-treatment can be, for example, a treatment for impregnating the cloth with a substance or substances selected from alkaline substances, water-soluble macromolecular substances, synthetic macromolecular substances, water-soluble metal salts, urea and thiourea.

Examples of the alkaline substance include alkali metal hydroxides such as sodium hydroxide or potassium hydroxide; amines such as mono-, di- or triethanolamine; alkali metal salts of carbonate or bicarbonate such as sodium carbonate, potassium carbonate or sodium bicarbonate; metal salts of organic acids such as calcium acetate or barium acetate; ammonia and ammonia compounds. Also, there can be utilized a substance which becomes alkaline under steaming or under dry heating, such as sodium trichloroacetate. Particularly preferred as the alkaline substance are sodium carbonate and sodium bicarbonate which are employed in the dyeing with reactive dyes.

Examples of the water-soluble macromolecular substances include starches for example of corn or wheat; cellulose substances such as carboxymethyl cellulose, methylcellulose or hydroxyethyl cellulose; polysaccharides such as sodium alginate, gum arabic, locust-bean gum, tragacanth gum, buna gum or tamarindo seed; proteins such as gelatin or casein; and natural water-soluble macromolecular substances such as tannines or lignines.

Also, examples of the synthetic macromolecular substance include polyvinyl alcohol compounds, polyethylene oxide compounds, water-soluble acrylic acid compounds, and water-soluble maleic anhydride compounds. Among these particularly preferred are polysaccharides and cellulosic compounds.

The water-soluble metal salts can be compounds having a pH value of 4 to 10 and capable of forming a typical ionic crystal, such as halides of alkali metals and alkaline earth metals. Representative examples of such compounds include NaCl, $Na_2SO_4$, KCl and $CH_3COONa$ for the alkali metals, and $CaCl_2$ and $MgCl_2$ for the alkaline earth metals. Among these particularly preferred are salts of Na, K and Ca.

The method of impregnating the cloth with these substances in the pre-treatment is not particularly limited, but can be immersion, padding, coating or spraying.

The ink applied to the cloth for ink jet printing is merely deposited at the stage of application, and is thereafter preferably subjected to a fixation process for the dye or pigment contained in the ink, such as fixation to the cloth fibers. Such fixation can be achieved by an already known method, such as steaming, HT steaming, thermofixing, or, in case the cloth is not treated with alkali in advance, alkali pad steaming, alkali bloch steaming, alkali shock or alkali cold fixing. The fixation process may include a reactive process or not depending on the dye, and an example of the latter consists of impregnation into the fibers, thereby achieving physical fixation. The ink to be used for this purpose may be of any type containing desired dyes, and there may also be employed pigments instead of dyes.

The unreacted dyes and the substance employed in the pre-treatment can be removed, after the fixation process mentioned above, by washing in the already known manner. At the washing process, there is preferably conducted, in combination, the already known fixing process.

The printed cloth subjected to the above-explained processes is then cut into pieces of desired sizes, and such cut pieces are then subjected to sewing, adhesion or fusion for obtaining the final product such as dresses, neckties, bathing suits, mattress covers, sofa covers, handkerchieves or curtains. The formation of clothings and similar products from cloth by sewing, etc. is an already well known technology.

The printing media include cloth, wall cloth, embroidering yarn, wall paper, paper, overhead projecting film, plate-shaped materials such as almite and other various materials on which liquid can be deposited by the ink jet technology, and the cloth includes woven, non-woven and other fabrics regardless of the material and the manner of weaving or knitting.

The foregoing embodiments have been explained by recording apparatus of ink jet recording type, but the present invention is not limited to such embodiments. For example it is naturally applicable to a thermal recording head.

Also the present invention is applicable to a system consisting of plural equipment and to an apparatus consisting of a single equipment. It is naturally applicable also to a case in which the present invention is achieved by the supply, to a system or an apparatus, of a program for executing a process defined by the present invention.

As explained in the foregoing, the present invention enables the conveying operation of the recording medium when the recording head is in a state other than at the stop position, thereby shortening the recording process time.

The present invention is not limited by the foregoing embodiments but is subject to various modifications within the scope and spirit of the appended claims.

What is claimed is:

1. A recording apparatus for effecting a recording on a recording medium with a recording head, comprising:

a print unit for executing the recording on the recording medium by the recording head moving forward and backward across the recording medium in a main scanning direction; and a conveying unit in which conveying means for conveying the recording medium in a direction different from the main scanning direction is provided, said conveying unit being connected to said print unit through a signal line, wherein said print unit comprises output means for outputting a first signal instructing conveyance of the recording medium through said signal line to said conveying unit when the recording head reaches an area outside of a print area in the main scanning direction, and wherein said conveying unit comprises control means for executing conveyance of a predetermined amount of the recording medium based on reception of the first signal instructing the conveyance of the recording medium and outputting a second signal, indicating that the conveyance is completed, to said print unit when the conveyance of the predetermined amount is completed, wherein said print unit controls a recording operation of recording by the recording head during main scanning in the print area based on reception of the second signal outputted from said conveying unit, and said print unit executes control such that the recording operation is not executed in a case where the second signal from the conveyance unit is not received before the recording head reaches the print area after the first signal is output.

2. A recording apparatus according to claim 1, wherein said print unit further comprises:

confirmation means for confirming completion of the conveyance by said conveying means at start of recording by said recording head during a moving period thereof; and inhibition means for inhibiting execution of recording in the moving period in case the completion of conveyance is not confirmed by said confirmation means.

3. A recording apparatus according to claim 2, further comprising:

waiting means for causing said recording head to wait in a predetermined waiting position, until the conveyance by said conveying means is completed after the end of the moving period in which the execution of recording is inhibited by said inhibition means.

4. A recording apparatus according to claim 3, wherein said recording head is an ink jet recording head for effecting recording by an ink jet process, and said ink jet recording head is subjected to capping in the waiting position.

5. A recording apparatus according to claim 1, wherein a timing of output of the first signal by said output means is a timing when said recording head moves past the recording medium.

6. A recording apparatus according to claim 1, wherein said output means outputs the first signal for instructing the conveyance of the recording medium when said recording head completes recording of an image in a recording scanning operation.

7. A recording apparatus according to claim 1, wherein said print unit further comprises:

detection means for detecting a joint in the recording medium, in a position in front of said recording head at least by a recording width thereof; and passing means for inhibiting start of motion of the recording head by said print unit at least while the joint is present in a recording scanning area, based on detection of the joint in the recording medium by said detection means, thereby causing the joint to pass through the recording scanning area of said recording head.

8. A recording apparatus according to claim 7, wherein said passing means includes:

discrimination means for discriminating whether the joint is present in a next recording scanning area of said recording head, based on the detection of the joint by said detection means; and passing conveyance means for causing the joint to pass through the recording scanning area prior to start of next movement of the recording head by said print unit, in case said discrimination means identifies that the joint is present in the next recording scanning area.

9. A recording apparatus according to claim 8, wherein said discrimination means is adapted to discriminate whether the joint is detected by said detection means, at the start of execution of the recording by said recording head.

10. A recording apparatus according to claim 7, wherein said print unit further comprises:

confirmation means for confirming the completion of conveyance by said conveying means at the start of execution of recording by said print unit and also confirming presence or absence of detection of the joint by said detection means; and inhibition means for inhibiting the execution of recording within a moving period in case the completion of conveyance is not confirmed by said confirmation means;

wherein said passing means is adapted, based on the presence or absence of the joint confirmed by said confirmation means, to inhibit the start of movement of the recording head by said print unit at least while the joint is present in the recording scanning area, thereby causing the joint to pass through the recording scanning area of said recording head.

11. A recording apparatus according to claim 7, wherein said passing means is adapted, based on the detection of the joint of the recording medium by said detection means, to divert said recording head to a position not interfering with the recording medium at least while the joint is present in the recording scanning area, and to inhibit the start of movement of the recording head by said printing unit, thereby causing the joint to pass through the recording scanning area of said recording head.

12. A recording apparatus according to claim 1, wherein said recording head comprises an ink jet recording head for effecting recording by ink discharge.

13. A recording apparatus according to claim 12, wherein said ink jet recording head discharges ink by thermal energy and comprises an energy converting member for generating the thermal energy to be applied to the ink.

14. A recording apparatus according to claim 13, wherein said ink jet recording head is adapted to cause a state change in the ink by the thermal energy applied by said energy converting member and to discharge the ink from a discharge opening based on the state change.

15. A recording apparatus provided with a recording control unit for controlling a recording scanning operation of a recording head, a conveying control unit for conveying a recording medium, and a communication unit for effecting communication between said recording control unit and said conveying control unit according to a predetermined communication protocol, wherein said recording control unit comprises:

recording means for causing reciprocating motions of said recording head in a main scanning direction in succession on the recording medium and causing said recording head to effect a recording operation on the recording medium during a moving period of the reciprocating motion in a print area, and recording control unit output means for sending, at the end of recording by said recording head in the moving period, a first signal instructing the conveying operation for the recording medium to said conveying control unit through said communication unit; and said conveying control unit comprises:

conveying means for conveying the recording medium by a predetermined amount in a subscanning direction, in response to reception of the first signal released by said recording control unit output means, and conveying control unit output means for outputting a second signal, indicating that conveyance is completed, through said communication unit to said recording control unit when the conveyance by the predetermined amount is completed, wherein said recording control unit controls the recording operation by said recording means based on reception of the second signal outputted from said conveying control unit output means, said recording control unit executes control such that the recording operation is not executed in a case where the second signal from the conveying control unit output means is not received before the recording head reaches the print area after the first signal is sent.

16. A recording apparatus according to claim 15, wherein:

said conveying control unit includes detection means for detecting a joint in the recording medium at a position at least a recording width in front of said recording head in a direction opposite to the subscanning direction;

said recording control unit includes inhibition means for inhibiting start of movement of said recording head, based on the detection of the joint of the recording medium, at least while the joint is present in a recording scanning area; and said conveying control unit includes passing means for causing the joint to pass through the recording scanning area of said recording head while the start of movement of said recording head is inhibited by said inhibition means.

17. A recording apparatus according to claim 16, wherein said recording head comprises an ink jet recording head for effecting recording by ink discharge.

18. A recording apparatus according to claim 17, wherein said ink jet recording head discharges the ink by thermal energy and comprises an energy converting member for generating the thermal energy to be applied to the ink.

19. A recording apparatus according to claim 18, wherein said ink jet recording head is adapted to cause a state change in the ink by the thermal energy applied by said energy converting member and to discharge the ink from a discharge opening based on the state change.

20. A recording control method in a recording apparatus having a print unit for executing a recording to a recording medium by an ink jet recording head during reciprocating motions of said recording head by reciprocating said recording head across the recording medium in a main scanning direction and a conveying unit including conveying means for conveying the recording medium in a subscanning direction different from the main scanning direction, the conveying unit being connected to the print unit through a signal line, said method comprising:

a recording step for causing the reciprocating motions of the recording head in the main scanning direction in succession on the recording medium and effecting a recording operation by the recording head on the recording medium during a moving period of the reciprocating motion in a print area;

a first output step for releasing a first signal for instructing conveyance of the recording medium, at the end of the recording operation by the recording head in the moving period and outputting the first signal from the print unit through the signal line to the conveying unit;

a conveying step for conveying the recording medium by a predetermined amount in the subscanning direction, in response to reception of the first signal released in said first output step;

a second output step of outputting a second signal from the conveying unit to the print unit indicating that the conveyance of the recording medium is completed when the conveyance of the recording medium by the predetermined amount is completed; and a recording control step of controlling the recording operation by the recording head based on reception of the second signal by the print unit, said recording control step controlling such that the recording operation is not executed in a case where the second signal is not received before the recording head reaches the print area after the first signal is released.

21. A recording control method according to claim 20, further comprising:

a detection step for detecting a joint in the recording medium, at a position at least a recording width in front of said recording head in a direction opposite to the subscanning direction; and a passing step for inhibiting the start of motion of the recording head and causing the joint to pass through a recording scanning area of said recording head, based on the detection of the joint in the recording medium in said detection step.

22. A recording control method utilizing a recording control unit for controlling a recording scanning operation of a recording head, a conveying control unit for conveying a recording medium, and a communication unit for effecting communication between the recording control unit and the conveying control unit according to a predetermined communication protocol, comprising:

in the recording control unit, a recording step for causing reciprocating motions of the recording head in a main scanning direction in succession on the recording medium and effecting a recording operation by the recording head on the recording medium during a moving period of the reciprocating motion in a print area;

in the recording control unit, a first output step for sending, at the end of recording by the recording head in the moving period, a first signal instructing the conveying operation for the recording medium to the conveying control unit through the communication unit;

in the conveying control unit, a conveying step for conveying the recording medium by a predetermined amount in a subscanning direction, in response to reception of the first signal released in the first output step;

in the conveying control unit, a second output step of outputting a second signal through the communication unit to the recording control unit indicating that conveyance of the recording medium is completed when the conveyance by the predetermined amount is completed; and further in the recording control unit, a control step of controlling the recording operation by the recording head based on reception of the second signal, said control step controlling such that the recording operation is not executed in a case where the second signal is not received before the recording head reaches the print area after the first signal is sent.

23. A recording control method according to claim 22, further comprising:

a detection step, in said conveying control unit, for detecting a joint in the recording medium at a position in front of said recording head by at least a recording width of said recording head in a direction opposite to the subscanning direction;

an inhibition step in said recording control unit for inhibiting the start of movement of said recording head, based on the detection of the joint of the recording medium, at least while the joint is present in a recording scanning area; and a passing step in said conveying control unit for causing the joint to pass through the recording scanning area of said recording head while the start of movement of said recording head is inhibited in said inhibition step.

24. A method for producing an ink jet recorded article by a recording apparatus having a print unit for executing a recording on a recording medium by a recording head during reciprocating motions of the recording head by reciprocating the recording head across the recording medium in a main scanning direction and a conveying unit including conveying means for conveying the recording medium in a subscanning direction different from the main scanning direction, the conveying unit being connected to the print unit through a signal line, said method comprising:

a recording step for causing the reciprocating motions of the ink jet recording head in the main scanning direction in succession on the recording medium and effecting a recording operation by the recording head on the recording medium during a moving period of the reciprocating motion in a print area;

a first output step for releasing a first signal instructing conveyance of the recording medium, at the end of the recording operation by the recording head in the moving period and outputting the first signal from the print unit through the signal line to the conveying unit;

a conveying step for conveying the recording medium by a predetermined amount in the subscanning direction, in response to reception of the first signal released in said first output step;

a second output step of outputting a second signal from the conveying unit to the print unit indicating that the conveyance of the recording medium is completed when the conveyance of the recording medium by the predetermined amount is completed; and a recording control step of controlling the recording operation by the recording head based on reception of the second signal by the print unit, said recording control step controlling such that the recording operation is not executed in a case where the second signal is not received before the recording head reaches the print area after the first signal is released.

25. A method according to claim 24, wherein the recording medium comprises woven cloth.

26. An article produced according to the method described in claim 25.

27. A method according to claim 24, further comprising a step of fixing the ink to the recording medium after recording by deposition of the ink to the recording medium.

28. A method according to claim 26, further comprising a step of washing the recording medium subjected to recording, after said step of ink fixing.

29. A method according to claim 24, further comprising a step of pre-treatment for impregnating the recording medium with a pre-treating agent, prior to the recording by the ink discharge from said recording head.

30. A method according to claim 24, wherein said recording head comprises an ink jet recording head for discharging ink by thermal energy and is provided with an energy converting member for generating the thermal energy to be applied to the ink.

31. A method according to claim 30, wherein said recording head is adapted to cause a state change in the ink by the thermal energy applied by said energy converting member and to discharge the ink from a discharge opening based on the state change.

* * * * *

UNITED STATES PATENT AND TRADEMARK OFFICE

CERTIFICATE OF CORRECTION

PATENT NO. : 6,076,911

DATED : June 20, 2000

INVENTOR(S) : WATANABE

It is certified that error appears in the above-identified patent and that said Letters Patent is hereby corrected as shown below:

On the title page: Item

[56] References Cited:
FOREIGN PATENT DOCUMENTS, "3046589" should read --3-46589--, and "5212851" should read --5-212851--.

COLUMN 1:
Line 25, "Ser." should be deleted.
Line 61, "more" should read --more compact--.

COLUMN 2:
Line 53, "a" should be deleted.
Line 65, "equality" should read --quality--.
Line 67, "a" should be deleted.

COLUMN 4:
Line 64, "by" should read --of--.

COLUMN 10:
Line 3, "a" should be deleted and "of" should read --in--.
Line 9, "a" should be deleted.
Line 20, "the" should read --its--.

COLUMN 11:
Line 43, "joint," should read --a joint,--.

COLUMN 12:
Line 36, "so positioned" should read --positioned so--.
Line 64, "substance" should read --substances--.

UNITED STATES PATENT AND TRADEMARK OFFICE

CERTIFICATE OF CORRECTION

PATENT NO. : 6,076,911

DATED : June 20, 2000

INVENTOR(S) : WATANABE

It is certified that error appears in the above-identified patent and that said Letters Patent is hereby corrected as shown below:

COLUMN 13:
Line 6, "substance" should read --substances--.
Line 18, "stance" should read --stances--.
Line 21, "these" should read --those--.
Line 59, "clothings" should read --clothing--.

COLUMN 15:
Line 50, "means;" should read --means,--.

COLUMN 20:
Line 4, "claim 26," should read --claim 27,--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*